US011285747B2

(12) United States Patent
Kano

(10) Patent No.: US 11,285,747 B2
(45) Date of Patent: Mar. 29, 2022

(54) PRINTING DEVICE

(71) Applicant: SEIKO EPSON CORPORATION, Tokyo (JP)

(72) Inventor: Tomohisa Kano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/934,092

(22) Filed: Jul. 21, 2020

(65) Prior Publication Data

US 2021/0023863 A1 Jan. 28, 2021

(30) Foreign Application Priority Data

Jul. 22, 2019 (JP) ..... JP2019-134861

(51) Int. Cl.
*B41J 29/02* (2006.01)
*B41J 29/13* (2006.01)

(52) U.S. Cl.
CPC ..... *B41J 29/13* (2013.01)

(58) Field of Classification Search
CPC ..... B41J 29/02; B41J 29/12; B41J 29/13
See application file for complete search history.

(56) References Cited

U.S. PATENT DOCUMENTS

2007/0138193 A1* 6/2007 Aono ..... B41J 29/13 220/810
2018/0170064 A1* 6/2018 Higuchi ..... B41J 2/1754

FOREIGN PATENT DOCUMENTS

JP 2014-144572 8/2014

* cited by examiner

*Primary Examiner* — Matthew Luu
*Assistant Examiner* — Kendrick X Liu
(74) *Attorney, Agent, or Firm* — Workman Nydegger

(57) ABSTRACT

A printing device includes: a device case having a front aperture; a first hinge disposed in the device case; and a front cover that is disposed in the first hinge and that exposes or hides the front aperture. The first hinge includes: a joint member; a first rotation shaft that joins the front cover to the joint member; and a second rotation shaft that joins the device case to the joint member. When the front cover hides the front aperture, the joint member covers a gap between the device case and the front cover inside the device case.

5 Claims, 13 Drawing Sheets

PRINTING DEVICE

The present application is based on, and claims priority from JP Application Serial Number 2019-134861, filed Jul. 22, 2019, the disclosure of which is hereby incorporated by reference herein in its entirety.

BACKGROUND

1. Technical Field

The present disclosure relates to a printing device having a cover that hides or exposes an aperture.

2. Related Art

Some known printers have an opening/closing cover over an aperture, as disclosed in JP-A-2014-144572.

If a user accidentally spills a liquid such as water over the opening/closing cover of a printer as described above, this liquid may flow into the printer through the gap between the opening/closing cover and the outer case even when the opening/closing cover is closed, and it might cause the printer to malfunction.

SUMMARY

According to an aspect of the present disclosure, A printing device includes: a case; a first cover configured to expose an inside of the case when in an open state and cover the inside of the case when in a closed state; and an opening/closing mechanism configured to rotatably connect the first cover to the case, the opening/closing mechanism including: a second cover positioned inside the case when the first cover is in the closed state, and configured to cover a gap between the case and the first cover; a first rotation shaft configured to connect the first cover to the second cover; and a second rotation shaft configured to connect the second cover to the case.

DESCRIPTION OF EXEMPLARY EMBODIMENTS

The following will describe a printing device 1 according to an embodiment of the present disclosure with reference to the accompanying drawings. All the drawings employ an X, Y, and Z coordinate system, in which the X-axis extends along the width of a continuous paper 20 (see FIG. 1), the Y-axis extends along the depth of the printing device 1, and the Z-axis extends along the height of the printing device 1. These X, Y, and Z axes intersect one another but are not necessarily orthogonal to one another.

The +X and −X directions on the X-axis correspond to the leftward and rightward directions, respectively, as viewed from the front of the printing device 1. Further, the +X and −X directions correspond to the main scanning directions of a print head 53 in the printing device 1. The +Y and −Y directions on the Y-axis correspond to the frontward and backward directions, respectively, as viewed from one side of the printing device 1. Further, the +Y direction corresponds to a transport direction of the continuous paper 20. The +Z and −Z directions on the Z-axis correspond to the upward and downward directions, respectively.

Internal Configuration of Printing Device

Figure 1:
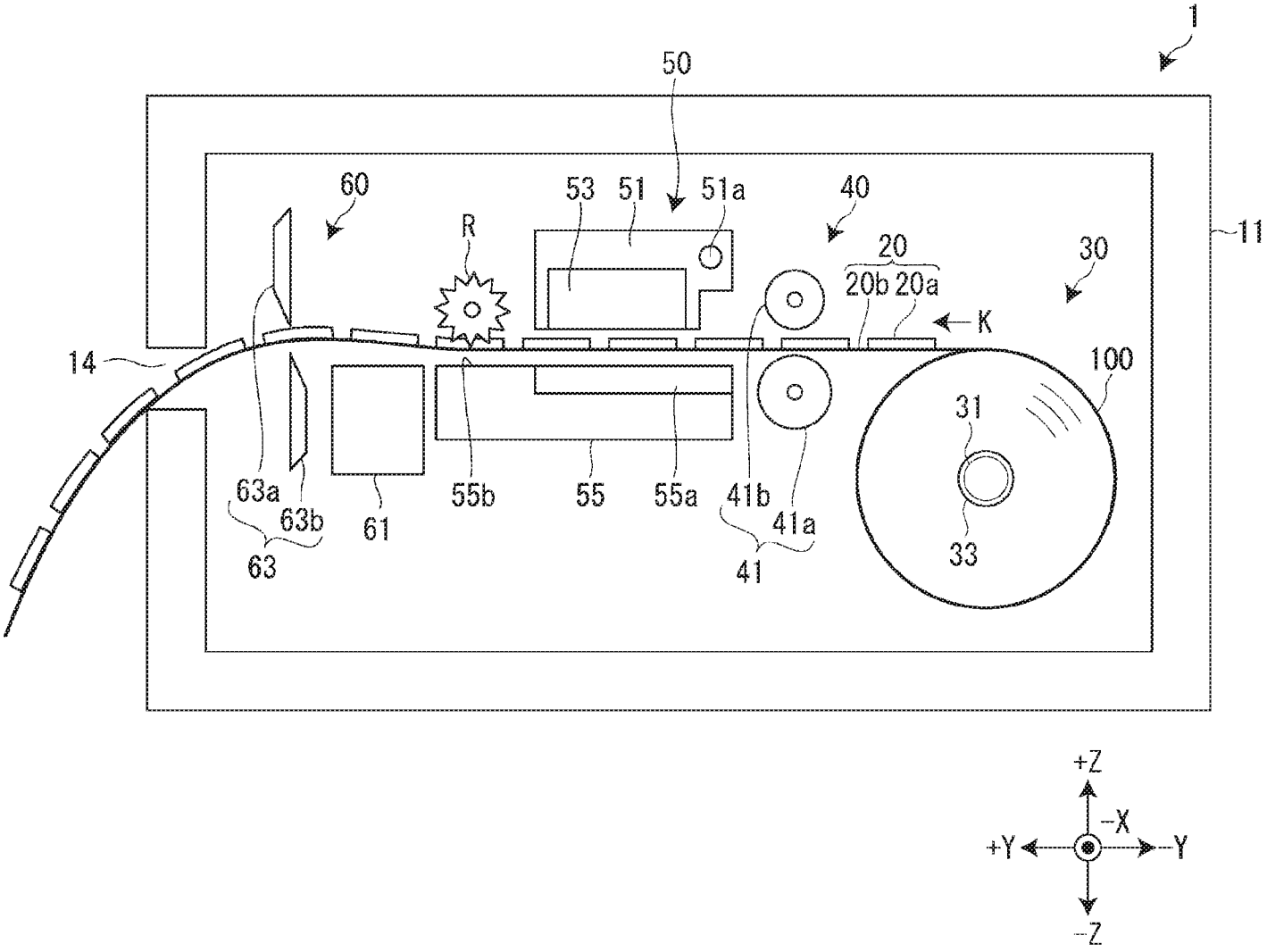
FIG. 1 is a schematic view of an internal configuration of a printing device according to an embodiment of the present disclosure.

As illustrated in FIG. 1, the printing device 1 is an ink jet printer, for example, that receives print data from a personal computer (PC) or other external information processing apparatus and, in accordance with this print data, performs a printing operation on the continuous paper 20 fed from a roll paper 100 along a transport route K. The roll paper 100 has a paper core 33 around which the continuous paper 20 is wound. The continuous paper 20 may be any given sheet; however, as an example, it may be a paper sheet in which a plurality of print media 20*a* such as labels are bonded at equal intervals on a pasteboard 20*b*.

The printing device 1 includes a roll paper holding section 30, a transport mechanism 40, a print mechanism 50, and a cutter mechanism 60.

The roll paper holding section 30 has a roll paper holder 31 to which the paper core 33 of the roll paper 100 is attached. When the roll paper holder 31 rotates, the roll paper 100 also rotates to feed the continuous paper 20. In this embodiment, the roll paper 100 rotates counterclockwise as viewed from the −X direction when feeding the continuous paper 20.

The transport mechanism 40 has a transport roller pair 41 that transports the continuous paper 20 along the transport route K. The transport roller pair 41 is disposed upstream of the print mechanism 50 in the transport direction of the continuous paper 20. The transport roller pair 41 has a drive roller 41*a* and a driven roller 41*b*; the drive roller 41*a* is driven to rotate by means of the power transmitted from an unillustrated drive source such as a transport motor, and the driven roller 41*b* rotates together with the drive roller 41*a*.

The transport mechanism 40 is configured to transport the continuous paper 20 not only in the forward direction, or the +Y direction, but also in the reverse direction, or in the −Y direction. If the print head 53 is a serial type of print head as in this embodiment, the transport mechanism 40 may transport the continuous paper 20 at a variable speed in an intermittent manner.

The print mechanism 50, which is disposed downstream of the transport mechanism 40 in the transport direction of the continuous paper 20, has a carriage 51, the print head 53, and a platen 55. The print head 53, which may be a serial type of ink jet head, is mounted on the carriage 51; the platen 55 is disposed opposite the print head 53 with the transport route K therebetween.

The carriage 51 is supported by a carriage shaft 51*a*, which extends in the main scanning directions, or the +X and −X directions, which intersect the transport direction of the continuous paper 20. The carriage 51 reciprocates along the carriage shaft 51*a* in the main scanning directions, thereby allowing the print head 53 to scan the continuous paper 20.

The print head 53 has nozzles arrayed in relation to a plurality of color inks, including cyan, yellow, magenta, and black inks. The print head 53 is supplied with the color inks from the respective ink cartridges and discharges the color inks through the nozzles. Then, the color inks land over a print medium 20*a* of the continuous paper 20, thereby creating an image, for example, on the print medium 20*a*.

The platen 55 has a vacuum platen 55*a* disposed opposite the print head 53; the vacuum platen 55*a* has a plurality of suction holes that communicate with an unillustrated vacuum fan. The vacuum platen 55*a* attracts the continuous paper 20 being transported so as to slide over the upper surface of the platen 55, thereby suppressing the continuous paper 20 from interfering with the discharging of the color inks from the print head 53 through the nozzles.

The platen 55 has a non-vacuum surface 55*b* with no suction holes, which is formed downstream of the vacuum platen 55*a* in the transport direction of the continuous paper 20. Disposed opposite the non-vacuum surface 55*b* with the transport route K therebetween is a toothed roller R, which suppresses the continuous paper 20 from floating over the non-vacuum surface 55*b*.

The cutter mechanism 60 includes a cutter unit 61 and a cutter member 63 that cut the continuous paper 20. Both of the cutter unit 61 and the cutter member 63 are disposed downstream of the print mechanism 50 in the transport direction of the continuous paper 20. The cutter unit 61 has an unillustrated drive source, such as a cutter motor, that drives the cutter member 63; the cutter member 63 has a movable blade 63*a* and a fixed blade 63*b*, respectively, as a first blade and a second blade. The cutter mechanism 60 rotates the movable blade 63*a* and simultaneously moves it along the fixed blade 63*b* in +X or −X direction, thereby cutting the continuous paper 20.

External Configuration of Printing Device

Figure 2:
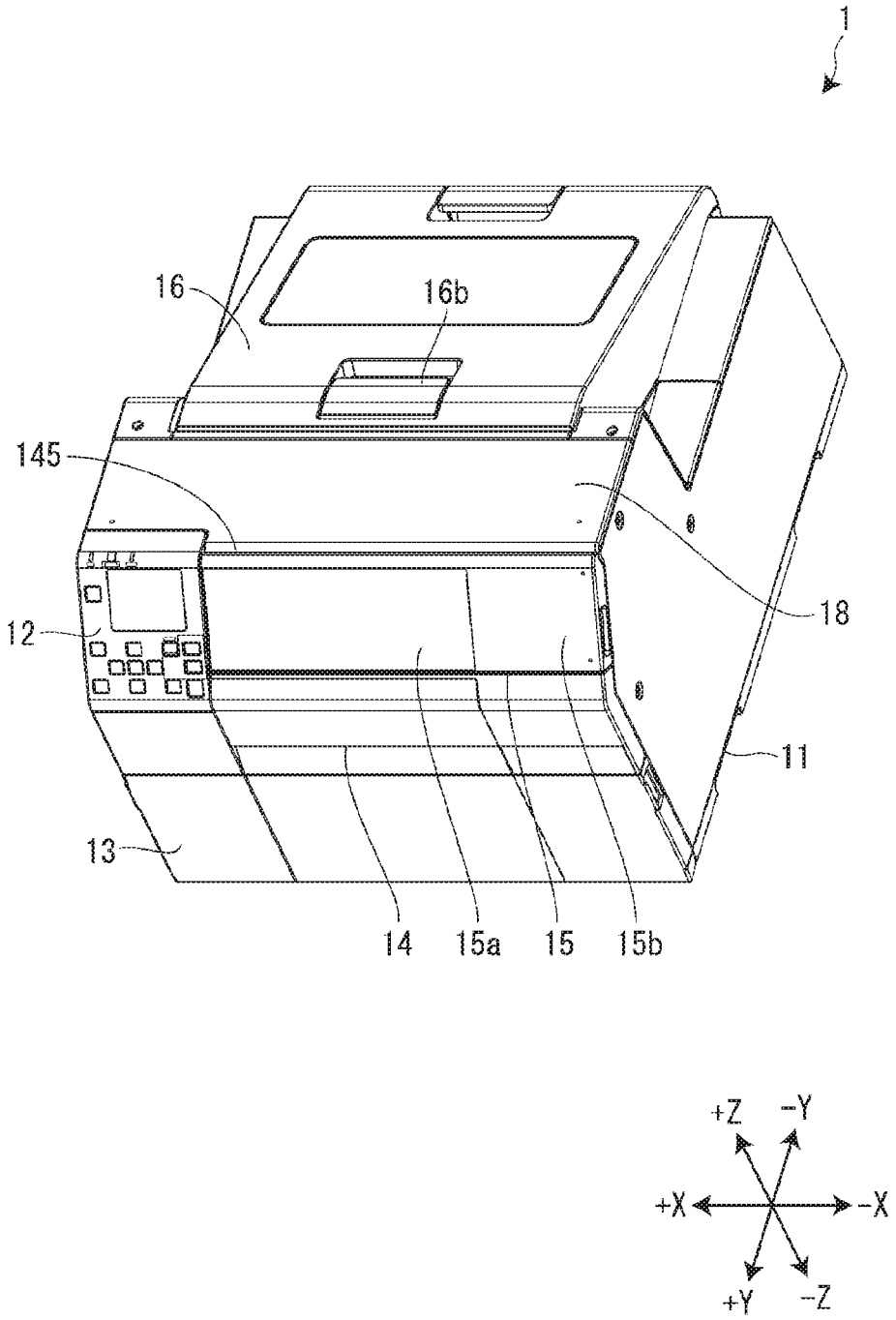
FIG. 2 is a perspective view of the printing device with the front cover being closed.
Figure 3:
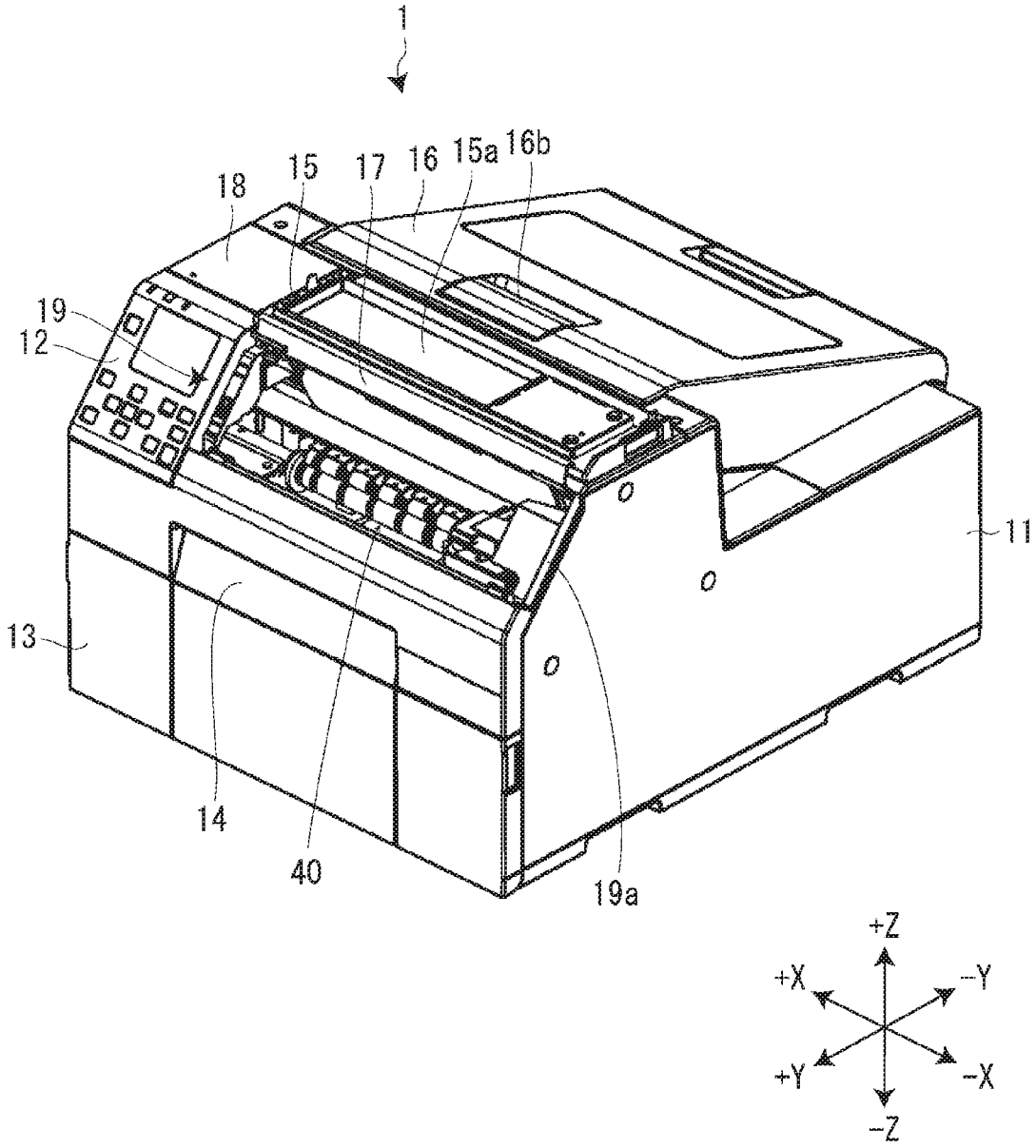
FIG. 3 is a perspective view of the printing device with the front cover being open.

As illustrated in FIGS. 2 and 3, the printing device 1 includes a device case 11 having a substantially rectangular parallelepiped shape. Herein, the device case 11 may correspond to an example of a case. The device case 11 has a front surface with a display/operation panel 12 on which a display unit and various buttons are arranged. Disposed next to the display/operation panel 12 in the −Z direction is an ink cartridge replacement section 13, which can be pulled out from the front surface.

Disposed next to the display/operation panel 12 in the −X direction on the front surface of the device case 11 is a front cover 15. Herein, the front cover 15 may correspond to an example of a first cover. The front cover 15 hides or exposes a front aperture 19 formed on the front surface of the device case 11. More specifically, the front cover 15 exposes the front aperture 19 when it is open and hides (covers) the front aperture 19 when it is closed. In other words, the front cover 15 exposes an inside of the device case 11 when it is open and hides an inside of the device case 11 when it is closed. The state where the front cover 15 exposes the front aperture 19 is an example of a state where the front cover 15 is open, or an opened state of the front cover 15. The state where the front cover 15 hides the front aperture 19 is an example of a state where the front cover 15 is closed, or a closed state of the front cover 15. The front cover 15 is rotatable around a first hinge 17 disposed on the side (+Z-side) of the front cover 15 in the +Z direction. When the front cover 15 is open, the transport mechanism 40 is exposed to the outside of the device case 11 through the front aperture 19 (see FIG. 3). When the continuous paper 20 is stuck inside the printing device 1, a user can remove it by opening the front cover 15 and inserting his/her hand into the device case 11 through the front aperture 19.

The front cover 15 is a substantially rectangular shape with its long side parallel to the X-axis. The front cover 15 is disposed on the front surface of the printing device 1 so that the user can easily notice it. The front cover 15 has a window 15*a* and a logo display 15*b*; the window 15*a* may be made of a transparent material so that the user can view the interior of the device case 11 through the window 15*a* even when the front cover 15 is closed. Displayed on the logo display 15*b* may be an unillustrated log mark of the printing device 1.

Disposed next to the front cover 15 in the −Z direction on the front surface of the device case 11 is an ejection hole 14, through which the continuous paper 20 on which the print mechanism 50 has performed the printing operation is ejected to the outside.

Disposed on the top of the device case 11 is an upper cover 16, which is positioned on the side (−Y-side) of the upper area in the −Y direction and occupies a substantially half the entire upper surface of the printing device 1. The upper cover 16 hides or exposes an unillustrated upper aperture formed on the upper surface of the device case 11. The upper cover 16 is rotatable around an unillustrated second hinge disposed on the −Y-side of the upper surface. When the upper cover 16 is open, the roll paper holding section 30 is exposed to the outside through the upper aperture. By releasing an opening/closing lock 16*b* on the +Y-side of the upper cover 16, the user can open the upper cover 16. Then, by inserting his/her hand into the device case 11 through the upper aperture, the user can load the roll paper 100 into the printing device 1.

Front Cover

Figure 4:
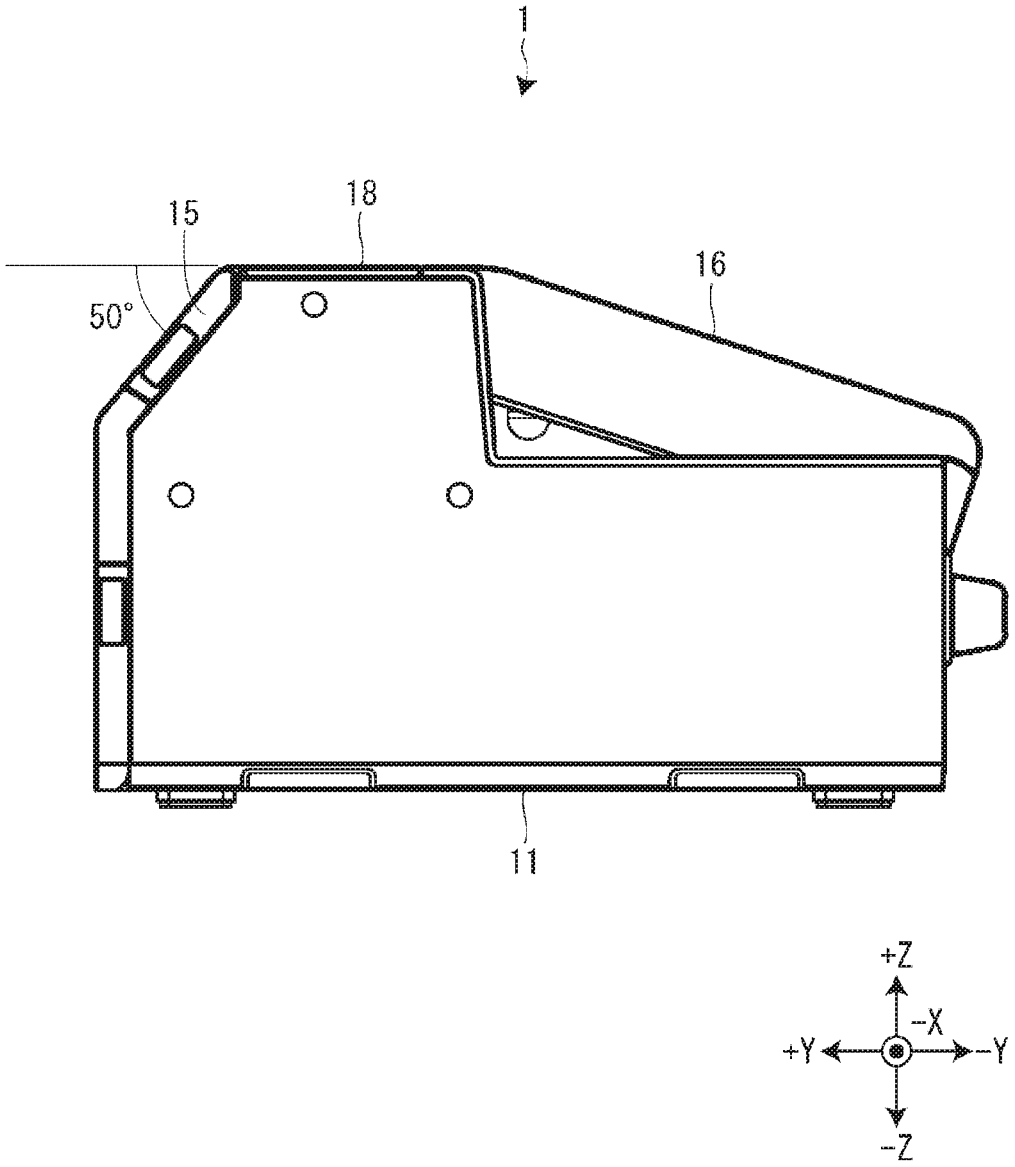
FIG. 4 is a side view of the printing device with the front cover being closed, as viewed from the −X direction.
Figure 5:
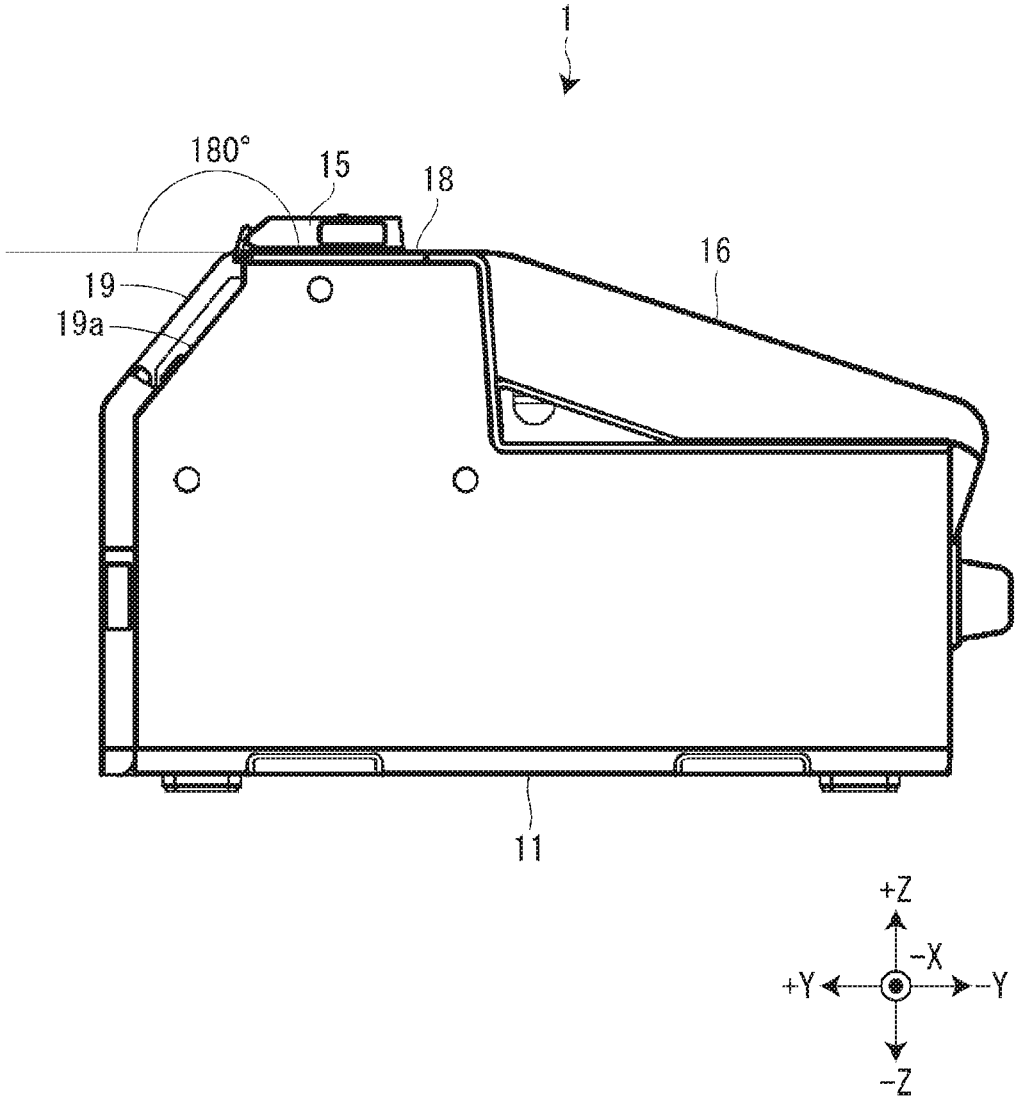
FIG. 5 is a side view of the printing device with the front cover being open, as viewed from the −X direction.

As illustrated in FIGS. 4 and 5, the front cover 15, which hides or exposes the front aperture 19, is rotatably joined (connected) to a case wall 18 through a first hinge 17; the case wall 18 is a portion of the device case 11 in the +Z direction. Herein, the front cover 15 may correspond to an example of a cover, and the front aperture 19 may correspond to an example of an aperture. The rotation angle of the front cover 15 is 180 degrees or more, for example, about 230 degrees as in this embodiment.

As illustrated in FIG. 4, the front cover 15, when closed, forms an angle of about 50 degrees with the extension of the case wall 18 as viewed from the −X direction. In this case, the front cover 15 is supported by a rim 19*a* (see FIG. 5)

around the front aperture 19. The rim 19*a* helps protect the front cover 15 from external force when the front cover 15 is closed.

As illustrated in FIG. 5, the front cover 15, when open, forms an angle of about 180 degrees with the extension of the case wall 18 as viewed from the −X direction. In this case, the front cover 15 is supported by the case wall 18. The case wall 18 helps protect the front cover 15 from external force when the front cover 15 is open.

Figure 8:
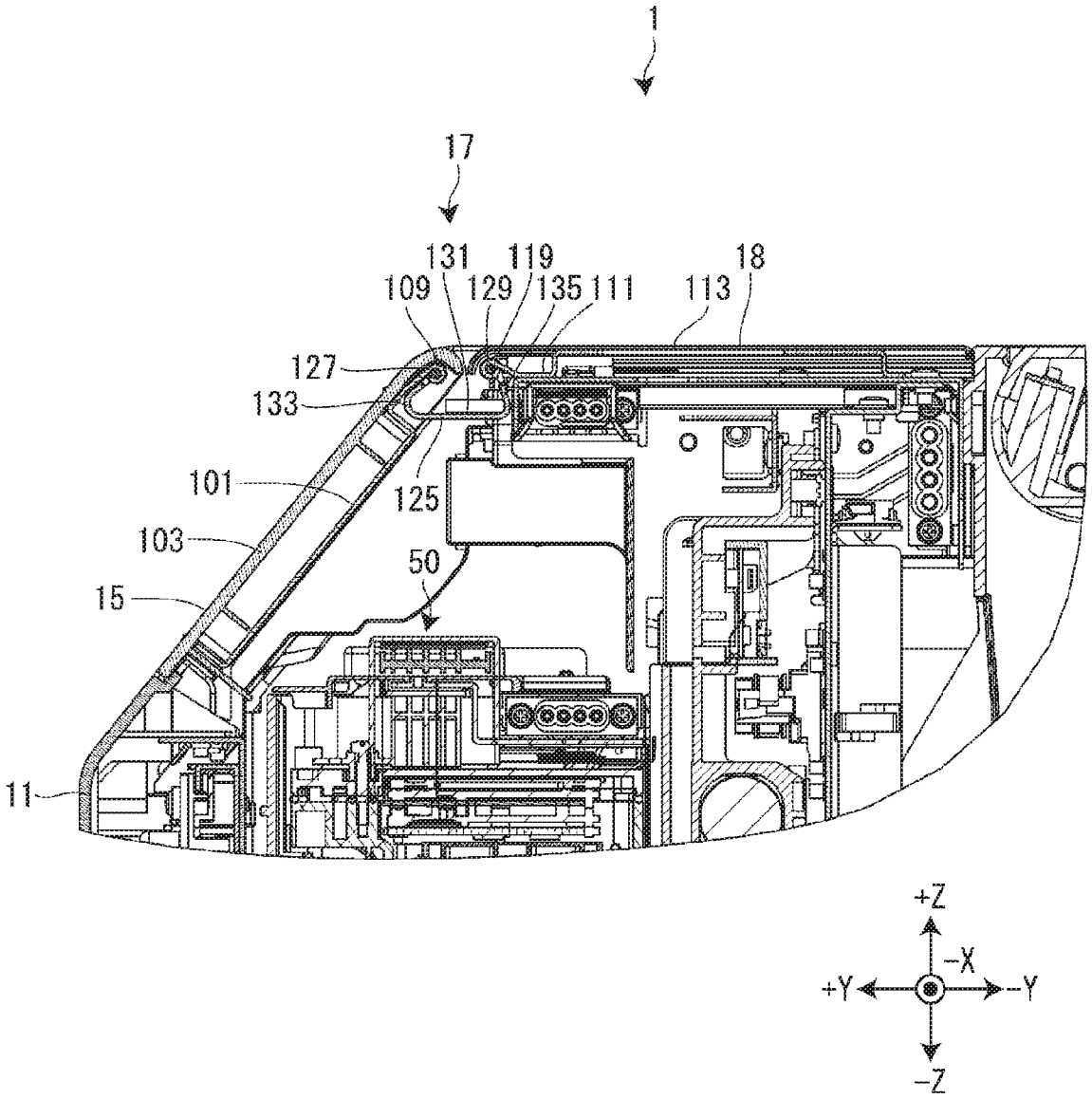
FIG. 8 is an enlarged, partial, and sectional view of the first rotation shaft, the second rotation shaft, and some other surrounding parts in the printing device with the front cover being closed, as viewed from the −X direction.

The front cover 15 includes: an inside-cover member 101; and an outside-cover member 103 disposed outside the inside-cover member 101 (see FIG. 8). The expression "outside the inside-cover member 101" means outside the inside-cover member 101 when the front cover 15 is closed.

Figure 6:
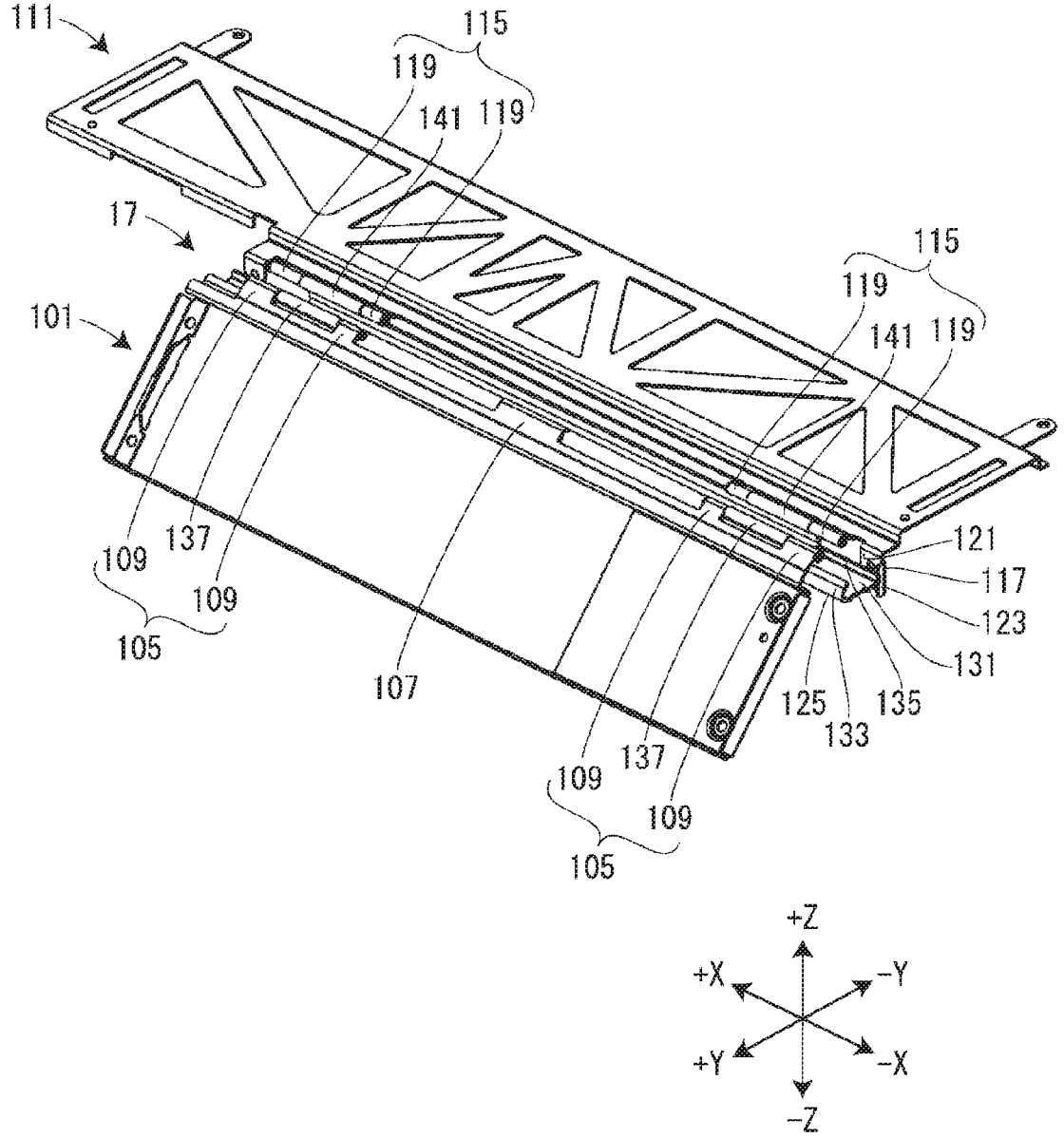
FIG. 6 is a perspective view of an inside-cover member, an inside-case member, and a first hinge in the printing device.
Figure 7:
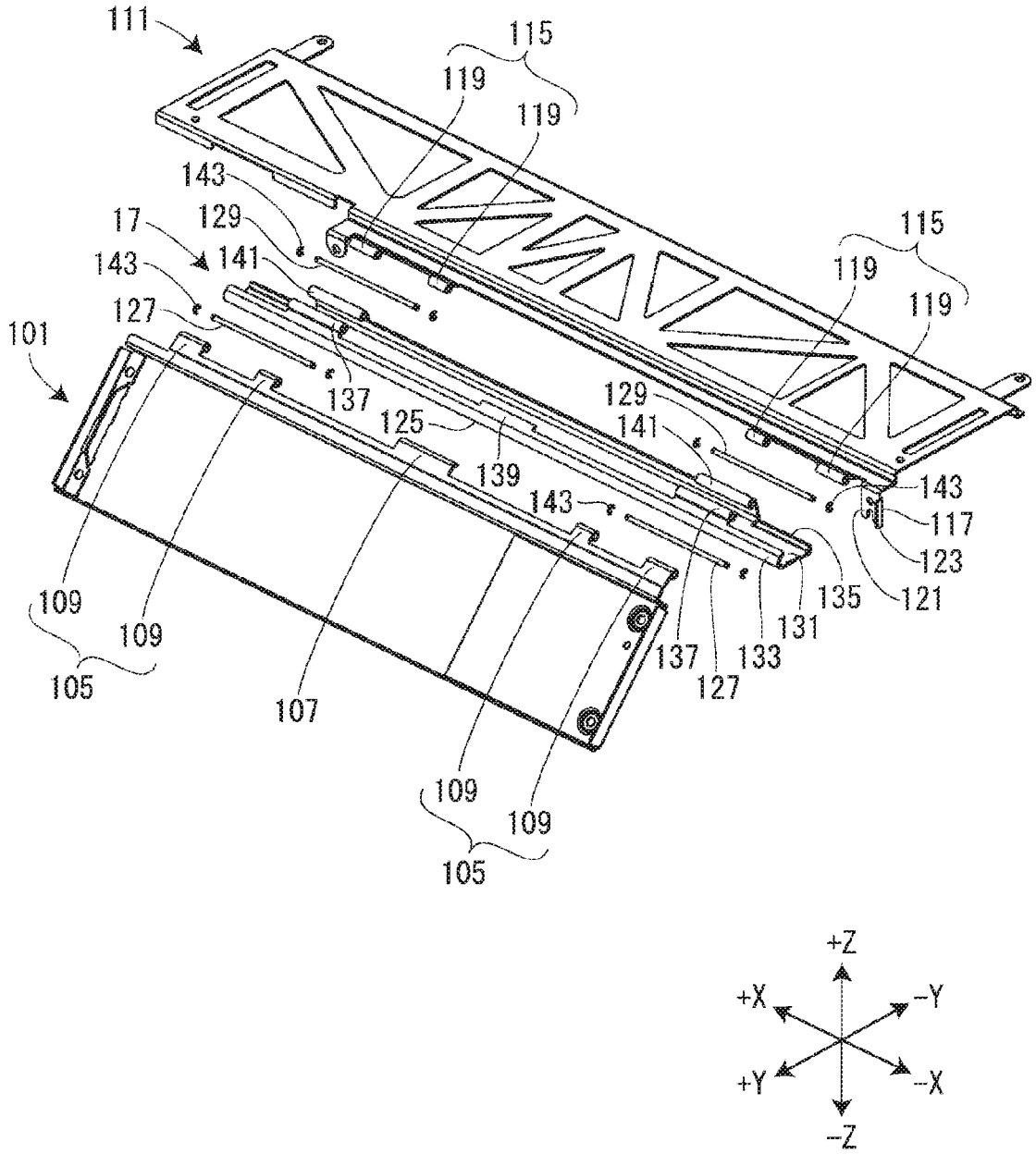
FIG. 7 is an exploded perspective view of the inside-cover member, the inside-case member, and the first hinge.

As illustrated in FIGS. 6 and 7, the +Z-side of the inside-cover member 101 is provided with two cover-side shaft engagement sections 105 and a cover-side rotation regulator 107. The expression "the +Z-side of the inside-cover member 101" means that the +Z-side of the inside-cover member 101 when the front cover 15 is closed (see FIG. 8).

The cover-side shaft engagement sections 105 are arranged on the +Z-side of the inside-cover member 101 while being a predetermined distance apart from each other in parallel with the X-axis. The cover-side shaft engagement sections 105 rotatably engage with respective first rotation shafts 127, details of which will be described later. Each of the cover-side shaft engagement sections 105 has two cover-side shaft insertion sections 109. Each of the first rotation shafts 127 passes through two cover-side shaft insertion sections 109. The cover-side rotation regulator 107 is disposed at substantially the center, in the +X direction, of the +Z-side of the inside-cover member 101.

Case Wall

The case wall 18 supports the front cover 15 so as to be rotatable around the first hinge 17. The case wall 18 includes: an inside-case member 111; and an outside-case member 113 disposed outside the inside-case member 111 in the +Z direction (see FIG. 8).

As illustrated in FIGS. 6 and 7, the inside-case member 111 may be formed of a substantially rectangular framework with its long side parallel to the X-axis. The +Y-side of the inside-case member 111 has two case-side shaft engagement sections 115 and a first stopper 117.

The case-side shaft engagement sections 115 are arranged on the +Y-side of the inside-case member 111 while being a predetermined distance apart from each other in parallel with the X-axis. The case-side shaft engagement sections 115 rotatably engage with respective second rotation shafts 129, details of which will be described later. Each of the case-side shaft engagement sections 115 has two case-side shaft insertion sections 119. Each of the second rotation shafts 129 passes through two case-side shaft insertion sections 119.

The first stopper 117 is disposed at the corner of the inside-case member 111 in the −X and +Y directions. The first stopper 117 has a first projection 121 and a second projection 123. The first projection 121 projects in the −Z direction from the +Y-side of the inside-case member 111, whereas the second projection 123 projects in the +Y direction from the side (−X-side) of the first projection 121 in the −X direction. When the front cover 15 is being closed, the second projection 123 abuts against the −Y-side of a joint member 125 (see FIG. 10), details of which will be described later.

First Hinge

The first hinge 17 rotatably joins the inside-cover member 101 to the inside-case member 111. Herein, the first hinge 17 may correspond to an example of an opening/closing mechanism. As illustrated in FIGS. 6 and 7, the first hinge 17 is provided with the joint member 125, the two first rotation shafts 127, and the two second rotation shafts 129.

The joint member 125, which may take the shape of a gutter, extends in parallel with the X-axis. Herein, the joint member 125 may correspond to an example of a second cover. The joint member 125 includes a bottom wall 131, a first side wall 133, and a second side wall 135. The bottom wall 131, which may have a substantially rectangular shape, extends in parallel with the X-axis. The first side wall 133 projects in the +Z direction from the +Y-side of the bottom wall 131 and is curved in the −Y direction, whereas the second side wall 135 projects in the +Z direction from the −Y-side of the bottom wall 131. It should be noted that a side of the joint member 125 in a certain direction, such as +Y direction, corresponds to that when the front cover 15 is closed (see FIG. 8).

The +Z-side of the first side wall 133 is provided with two joint-side first shaft engagement sections 137 and a joint-side rotation regulator 139. Both of the joint-side first shaft engagement sections 137 are arranged on the +Z-side of the first side wall 133 in parallel with the X-axis with a predetermined spacing therebetween. The joint-side first shaft engagement sections 137 rotatably engage with the respective first rotation shafts 127. In other words, the first rotation shafts 127 are inserted into the respective joint-side first shaft engagement sections 137.

The joint-side rotation regulator 139 is disposed at substantially the center, in the +X or −X direction, of the +Z-side of the first side wall 133. When the user rotates the front cover 15 counterclockwise by about 50 degrees or more as viewed from the −X direction in order to close the front cover 15, the joint-side rotation regulator 139 engages with the cover-side rotation regulator 107. Once the joint-side rotation regulator 139 engages with the cover-side rotation regulator 107, the front cover 15 is no longer allowed to rotate counterclockwise. This configuration successfully suppresses the inside-cover member 101 from making contact with the device case 11 and damaging it when the unit of the inside-cover member 101, the inside-case member 111, and the first hinge 17 is installed inside the device case 11 during the assembly of the printing device 1.

The +Z-side of the second side wall 135 is provided with two joint-side second shaft engagement sections 141. Both of the joint-side second shaft engagement sections 141 are arranged in parallel with the X-axis with a predetermined spacing therebetween. The joint-side second shaft engagement sections 141 rotatably engage with the respective second rotation shafts 129. In other words, the second rotation shafts 129 are inserted into the respective joint-side second shaft engagement sections 141.

The first rotation shafts 127 rotatably join the inside-cover member 101 to the joint member 125. The first rotation shafts 127 are inserted into the cover-side shaft insertion sections 109 and the joint-side first shaft engagement section 137 while each joint-side first engagement section 137 is interposed between the corresponding cover-side shaft insertion sections 109. Both ends of each first rotation shaft 127 are provided with respective snap rings 143, which may be an E-ring, for example. Herein, the expression "first rotation shafts 127 rotatably join the inside-cover member 101 to the joint member 125" may be interpreted as "first rotation shafts 127 rotatably couple the inside-cover member 101 to the joint member 125".

The second rotation shaft 129 rotatably joins the inside-case member 111 to the joint member 125. The second rotation shafts 129 are inserted into case-side shaft insertion sections 119 in the case-side shaft engagement sections 115 and the joint-side second shaft engagement section 141 while each joint-side second shaft engagement section 141 are interposed between the corresponding case-side shaft insertion sections 119. Both ends of each second rotation shaft 129 are provided with respective snap rings 143, which may be an E-ring, for example. Herein, the expression "the second rotation shaft 129 rotatably joins the inside-case member 111 to the joint member 125" may be interpreted as "the second rotation shaft 129 rotatably couples the inside-case member 111 to the joint member 125".

Figure 9:
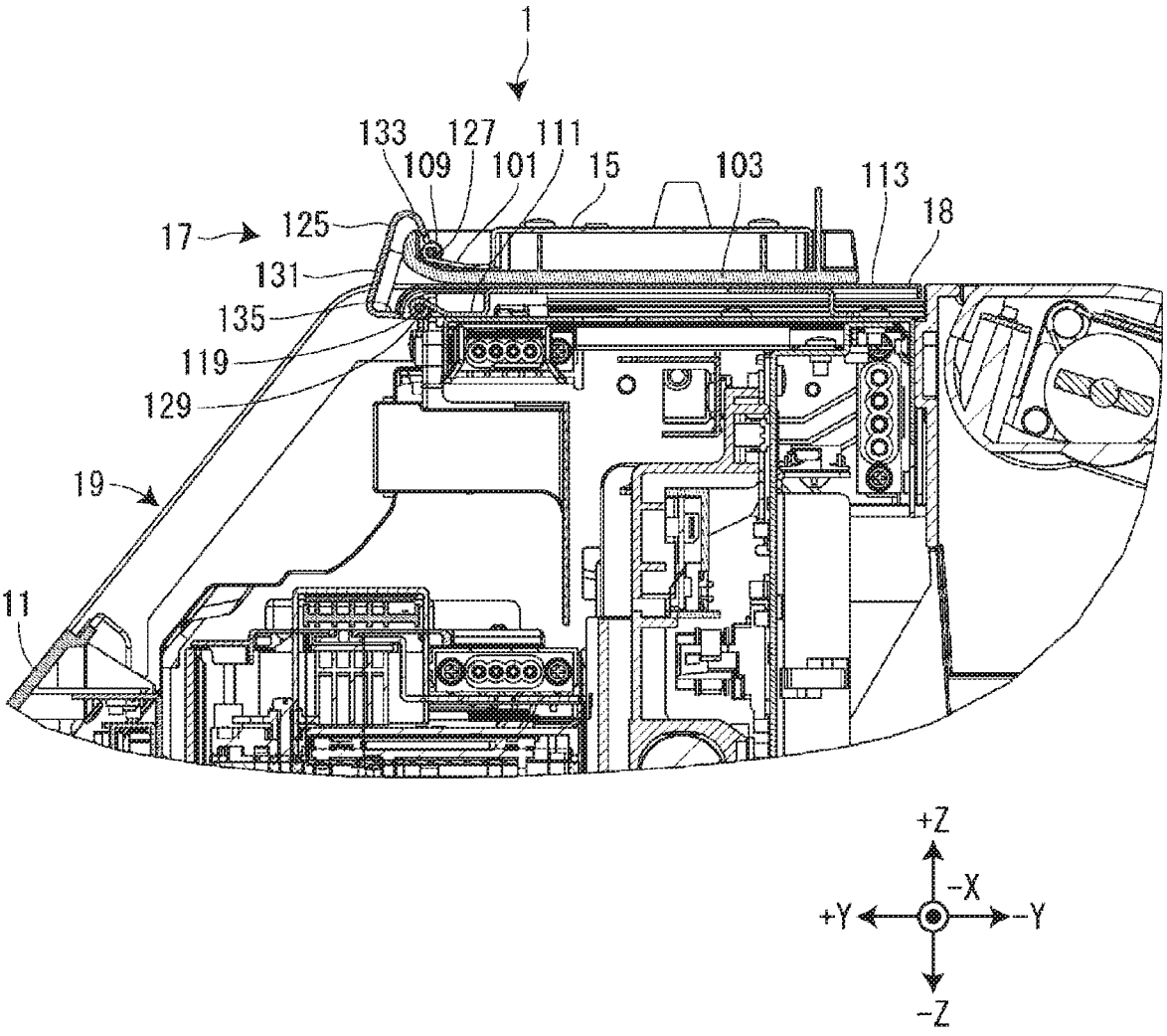
FIG. 9 is an enlarged, partial, and sectional view of the first rotation shaft, the second rotation shaft, and some other surrounding parts in the printing device with the front cover being open, as viewed from the −X direction.

As described above, the first rotation shafts 127 rotatably join the inside-cover member 101 to the joint member 125, and the second rotation shafts 129 also rotatably join the inside-case member 111 to the joint member 125. When the front cover 15 is open or closed, as illustrated in FIG. 8 or 9, the front cover 15 rotates around the first rotation shaft 127, and the joint member 125 also rotates around the second rotation shaft 129. This configuration enables the front cover 15 to rotate by an angle of 180 degrees or more relative to the case wall 18.

The front cover 15 is rotatably joined to the case wall 18 by the first hinge 17 disposed inside the device case 11. The device case 11 thus does not need to support the front cover 15 from the +X or −X side. Consequently, the border between the front cover 15 and the case wall 18 is formed of a single parting line, or a borderline 145 (see FIG. 2).

Figure 10:
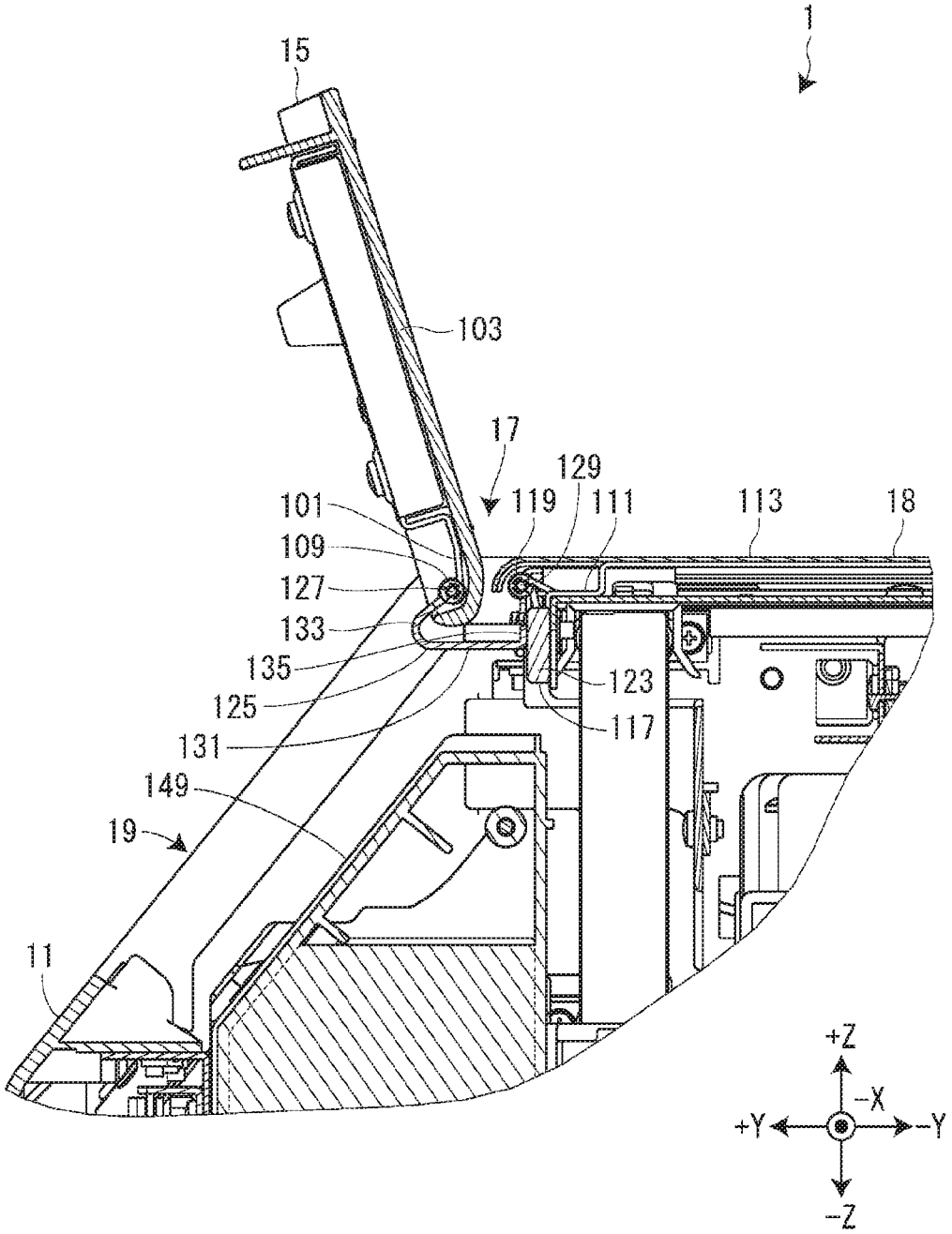
FIG. 10 is an enlarged, partial, and sectional view of the joint member and some other surrounding parts in the printing device when the front cover is being closed, as viewed from the −X direction.
Figure 11:
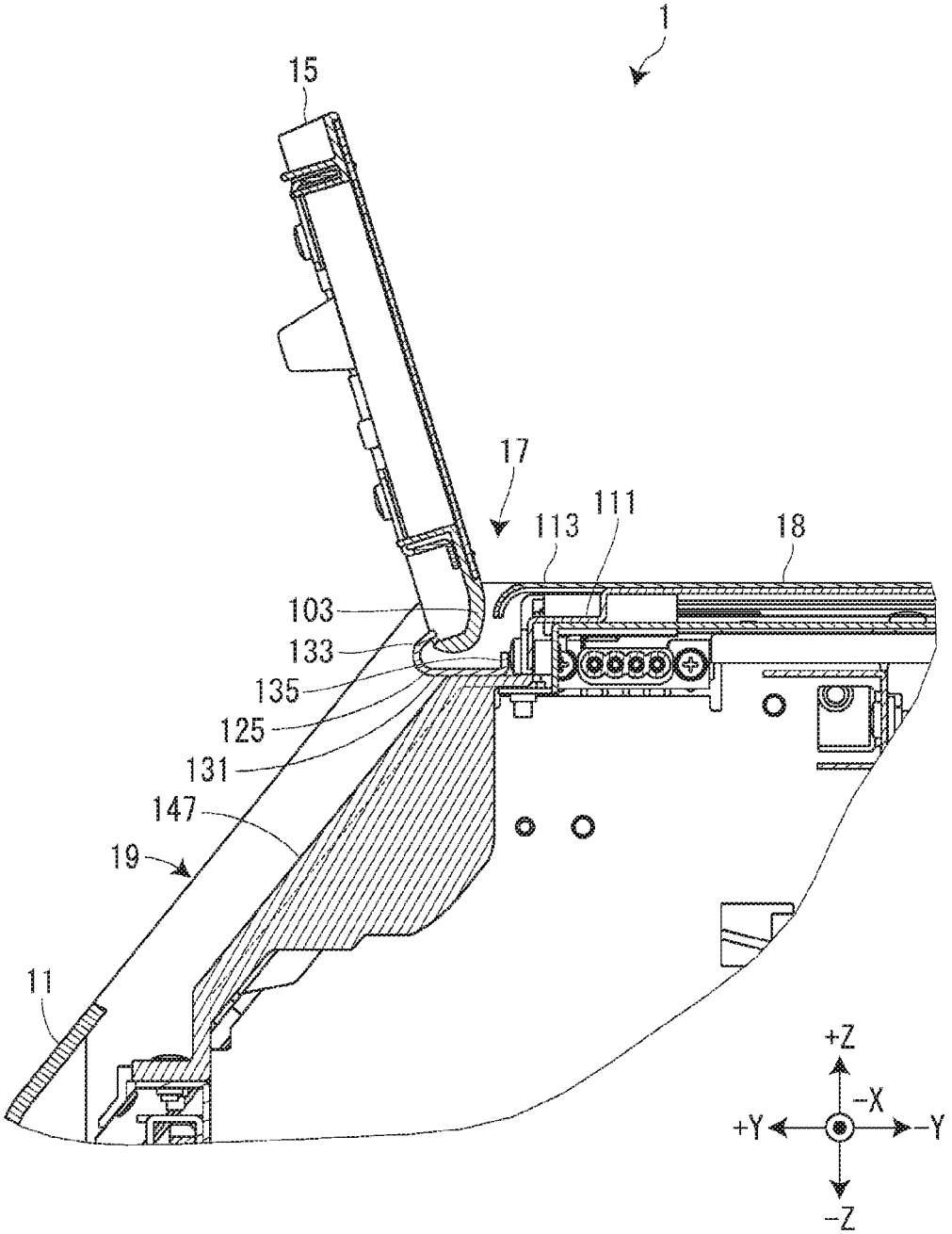
FIG. 11 is an enlarged, partial, and sectional view of the joint member and the surrounding parts in the printing device when the front cover is being opened, as viewed from the −X direction.

As illustrated in FIG. 10, when the front cover 15 is being closed, the −X-side of the second side wall 135 of the joint member 125 abuts against the second projection 123 of the first stopper 117. Moreover, as illustrated in FIG. 11, when the front cover 15 is being closed, the +X-side of the bottom wall 131 of the joint member 125 abuts against the upper surface of a second stopper 147 disposed inside the display/operation panel 12.

As described above, when the front cover 15 is being closed, the −X-side of the joint member 125 abuts against the first stopper 117, and the +X-side of the joint member 125 also abuts against the second stopper 147. As a result, the joint member 125 is positioned on the rotational path around the second rotation shaft 129. More specifically, when the front cover 15 is closed, the bottom wall 131 of the joint member 125 is positioned in substantially parallel with the X-Y plane. This configuration suppresses the +Y-side of the joint member 125 from sloping down, thereby successfully positioning the front cover 15 precisely.

Figure 12:
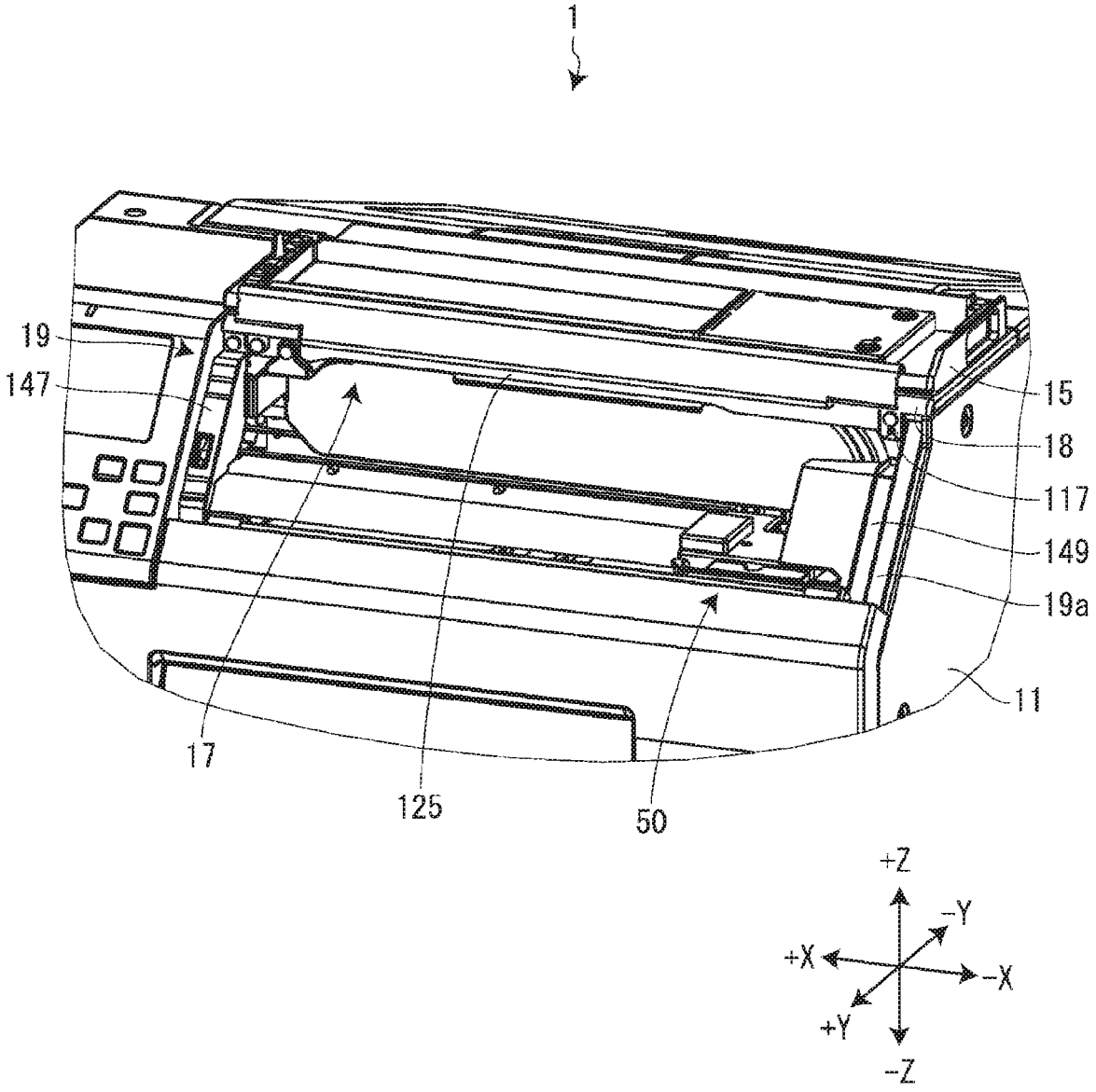
FIG. 12 is an enlarged, partial, and perspective view of the printing device with the front cover being open.

As illustrated in FIG. 12, the first stopper 117 is disposed next to the front aperture 19 in the −X-direction, whereas the second stopper 147 is disposed next to the front aperture 19 in the +X-direction. This configuration successfully suppresses both the first stopper 117 and the second stopper 147 from interfering with the motion of the user's hand when the user opens the front cover 15 and inserts his/her hand into the printing device 1 through the front aperture 19. Herein, the first stopper 117 and the second stopper 147 may correspond to examples of a stopper. The printing device 1 does not necessarily have to be provided with both of the first stopper 117 and the second stopper 147. Alternatively, the printing device 1 may be provided with either one of the first stopper 117 and the second stopper 147.

As illustrated in FIG. 8, when the front cover 15 is closed, the joint member 125 is positioned next to the print mechanism 50 in the +Z direction inside the device case 11 and covers the adjoining regions of the front cover 15 and the case wall 18. If the user accidentally spills liquid such as water over the front cover 15, the liquid may flow into the device case 11 through the gap between the front cover 15 and the case wall 18. Even in this case, the joint member 125 receives the liquid, thereby successfully suppressing the liquid from reaching the print mechanism 50.

The expression "the joint member 125 covers the adjoining regions of the front cover 15 and the case wall 18" means that the joint member 125 seamlessly covers the adjoining regions from their −X-side to +X-side or from a portion close to the −X-side to a portion close to the +X-side, as illustrated in FIG. 12.

Figure 13:
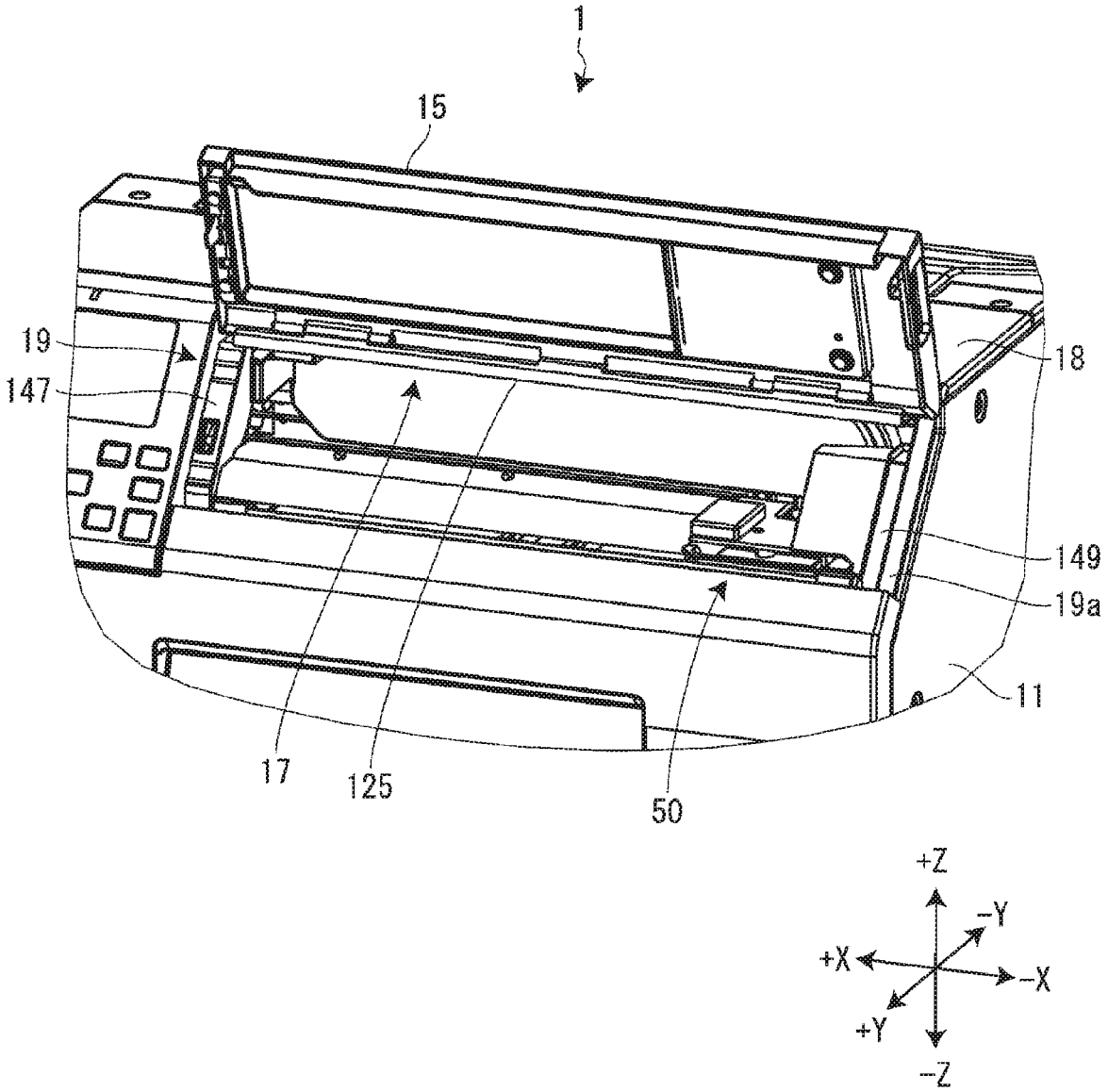
FIG. 13 is an enlarged, partial, and perspective view of the printing device when the front cover is being closed.

The +X-side of the joint member 125 is dead-ended by an unillustrated dead-end member, whereas the −X-side of the joint member 125 is open, as illustrated in FIG. 13. Furthermore, the slope 149 is disposed next to the −X-side of the joint member 125 in the −Z direction while sloping down in the +Y direction. Disposed next to the slope 149 in the −Z direction is an unillustrated liquid absorber. In other words, the slope 149 is disposed between the −X-side of the joint member 125 and the liquid absorber. In this configuration, when a liquid flows into the device case 11 through the gap between the front cover 15 and the case wall 18, it reaches the slope 149 via the −X-side of the joint member 125. Then, the liquid received by the slope 149 is guided to the liquid absorber and absorbed in it. Optionally, the joint member 125 may have a drainage slope that helps the liquid flow from the −X-side of the joint member 125.

In the printing device 1, as described above, the joint member 125 covers the adjoining regions of the front cover 15 and the case wall 18 inside the device case 11 when the front cover 15 is closed. If the user spills a liquid such as water over the front cover 15, the liquid may flow into the device case 11 through the gap between the front cover 15 and the case wall 18. Even in this case, the liquid is received by the joint member 125. In this way, the printing device 1 successfully suppresses the liquid from causing a malfunction when a liquid flows into the device case 11 through the gap between the front cover 15 and the case wall 18.

Modifications

The foregoing embodiment is not intended to narrow down the scope of the present disclosure and thus may be modified in various ways within the spirit of the disclosure. The following will describe some modifications of the embodiment.

The joint member 125 does not necessarily have to have a dead-end side and an open side in a longitudinal direction. As an alternative example, both sides of the joint member 125 may be dead-end. In this case, the joint member 125 may include: a structure in which the liquid that has flown into the device case 11 through the gap between the front cover 15 and the case wall 18 is stored; and a liquid absorber that absorbs the stored liquid. As another alternative example, both sides of the joint member 125 in the longitudinal direction may be open. In this case, the joint member 125 may include: a structure in which a liquid that has flown into the device case 11 through the gap between the front cover 15 and the case wall 18 is discharged from both the sides; and slopes 149 disposed under the respective sides of the joint member 125.

Bonded to one or both of the surface of the first stopper 117 in contact with the joint member 125 and the surface of the second stopper 147 in contact with the joint member 125 may be one or more sheet members having a predetermined thickness. Bonding the sheet members in this manner can adjust the size of the gap between the front cover 15 and the case wall 18 in such a way that the borderline 145 between the front cover 15 and the case wall 18 has a uniform thickness. This can provide the printing device 1 with a good appearance.

The print mechanism 50 may employ not only an ink jet print system but also a thermal print system or other print system. The print head 53 may be a line type of print head, instead of a serial type of print head.

The transport mechanism 40 does not necessarily have to transport a continuous paper 20 fed from the roll paper 100. Alternatively, the transport mechanism 40 may transport a continuous fanfold paper or cut paper sheets. It should be noted that the foregoing embodiments and modifications may be combined together as appropriate.

Supplementary Notes

The following will describe some supplementary notes of a printing device 1. The printing device 1 includes: a device case 11 having a front aperture 19; a front cover 15 that exposes the front aperture 19 when in an open state and that hides the front aperture 19 when in a closed state; and a first hinge 17 that rotatably joins the front cover 15 to the device case 11. The first hinge 17 includes: a joint member 125 that covers a gap between the device case 11 and the front cover 15 inside the device case 11 when the front cover 15 in the closed state; a first rotation shaft 127 joins the joint member 125 to the front cover 15; and a second rotation shaft 129 that joins the joint member 125 to the device case 11.

When a user accidentally spills a liquid such as water over the front cover 15, this liquid may flow into the device case 11 through the gap between the front cover 15 and the device case 11. Even in this case, the liquid is received by the joint member 125. Thus, with this configuration, the printing device 1 successfully suppresses the liquid from causing a malfunction when a liquid flows into the device case 11 through the gap between the front cover 15 and the case wall 18.

The printing device 1 may further include a print mechanism 50 that performs a printing operation on a continuous paper 20 fed from a roll paper 100. The joint member 125 may be positioned above the print mechanism 50 when the front cover 15 is in the closed state.

With this configuration, the printing device 1 successfully suppresses the liquid from causing a malfunction when a liquid flows into the device case 11 through the gap between the front cover 15 and the device case 11.

The printing device may further include a transport mechanism 40 that transports the continuous paper 20. The transport mechanism 40 may be exposed to an outside of the device case 11 through the front aperture 19 when the front cover 15 is in the open state.

With the above configuration, when the continuous paper 20 is stuck inside the device case 11, the user can easily remove the continuous paper 20 from the device case 11 by opening the front cover 15 and inserting his/her hand into the device case 11 through the front aperture 19.

In the printing device 1, the gap between the device case 11 and the front cover 15 may form a single borderline 145 that extends in parallel with the X-axis.

The above configuration successfully provides the printing device 1 with a good appearance design.

The printing device may further include a first stopper 117 and a second stopper 147 that abut against the front cover 15 when the front cover 15 is entering the closed state.

With the configuration, in which the joint member 125 abuts against both the first stopper 117 and the second stopper 147 when the front cover 15 is entering the closed state, the joint member 125 is positioned on the rotational path around the second rotation shaft 129.

The printing device may further include a slope 149 disposed inside the device case 11. The joint member 125 may be formed to, when a liquid flows into the gap between the front cover 15 and the device case 11, receive the liquid and guide the received liquid to the slope 149.

The above configuration discharges the liquid appropriately when a liquid flows into the device case 11 through the gap between the front cover 15 and the case wall 18.

What is claimed is:

1. A printing device comprising:

a case;

a first cover configured to expose an inside of the case when in an open state and cover the inside of the case when in a closed state; and an opening/closing mechanism configured to rotatably connect the first cover to the case, the opening/closing mechanism including:

a second cover positioned inside the case when the first cover is in the closed state, and configured to cover a gap between the case and the first cover;

a first rotation shaft configured to connect the first cover to the second cover;

a second rotation shaft configured to connect the second cover to the case; and a print mechanism configured to perform a printing operation on a continuous paper fed from a roll paper, wherein the second cover is positioned above the print mechanism when the first cover is in the closed state.

2. The printing device according to claim 1, further comprising a transport mechanism configured to transport the continuous paper, wherein the transport mechanism is exposed to an outside of the case through an aperture of the case when the first cover is in the open state.

3. The printing device according to claim 2, wherein the gap between the case and the first cover forms a single borderline which extends along a width of the continuous paper.

4. The printing device according to claim 1, further comprising a stopper configured to abut against the first cover when the first cover is entering the closed state.

5. The printing device according to claim 1, further comprising a slope disposed inside the case, wherein the second cover is formed to, when a liquid flows into the gap between the first cover and the case, receive the liquid and guide the received liquid to the slope.

* * * * *